US005407094A

United States Patent [19]

Vajtay

[11] Patent Number: 5,407,094

[45] Date of Patent: Apr. 18, 1995

[54] TRANSPARENT DISPLAY PACKAGE DISPENSER WITH SEE-THROUGH REPLACEABLE CARTRIDGE

[75] Inventor: Thomas L. Vajtay, Somerset, N.J.

[73] Assignee: SLM Manufacturing Corp., Somerset, N.J.

[21] Appl. No.: 174,255

[22] Filed: Dec. 28, 1993

[51] Int. Cl.[6] ..... G07F 11/04

[52] U.S. Cl. ..... 221/193; 221/194; 221/197; 221/155; 221/287

[58] Field of Search ..... 221/191, 193, 194, 197, 221/22, 155, 286, 287, 294, 303, 312 C

[56] References Cited

U.S. PATENT DOCUMENTS

| | | | |
|---|---|---|---|
| 3,090,521 | 5/1963 | Fazekas | 221/197 X |
| 4,767,022 | 8/1988 | Oldorf | 221/191 X |
| 4,831,696 | 5/1989 | Elliott et al. | 221/197 X |
| 5,295,592 | 3/1994 | Thorne | 221/194 X |

FOREIGN PATENT DOCUMENTS

| | | | |
|---|---|---|---|
| 0345680 | 6/1989 | European Pat. Off. | 221/191 X |
| 3-273469 | 12/1991 | Japan | 221/197 X |

*Primary Examiner*—Cheryl L. Gastineau
*Assistant Examiner*—Dean A. Reichard
*Attorney, Agent, or Firm*—Sughrue, Mion, Zinn, Macpeak & Seas

[57] ABSTRACT

A transparent display article dispenser, includes spaced front and rear walls and spaced side walls integral with the front and rear walls to define a vertical chute having open upper and lower ends. The front wall includes a first horizontal retainer flange projecting into the interior of the passageway at a lower end of the chute. The rear wall includes a second horizontal retainer flange projecting towards the first retainer flange and being spaced below the first retainer flange a distance in excess of the height of the article being dispensed. An opening is formed within the front wall below the first retainer flange for removal of an article resting on the second retainer flange. An elongated removable see-through tubular cartridge sized smaller in cross-section than the chute passageway and being configured to that passageway has a lower end inserted within the chute passageway and stores articles to be dispensed in a serial, abutting fashion. The lowermost article to be dispensed, falls by gravity from the open end of the cartridge into contact with the first retainer flange. An opening within the front wall permits the article to be pushed over the edge of the first retainer flange thereby permitting it to fall by gravity downwardly within a front to rear enlarged cavity into vertical upright position on the second retainer flange. Access is provided within the dispenser for manual grasping of the article on the second retaining flange to remove the same.

20 Claims, 2 Drawing Sheets

TRANSPARENT DISPLAY PACKAGE DISPENSER WITH SEE-THROUGH REPLACEABLE CARTRIDGE

The present invention relates to an apparatus for storing, displaying and dispensing small articles and more particularly to an apparatus for dispensing parallel packages such as cigarettes packages and articles of similar configuration held in a replaceable, tubular cartridge insertable within the upper end of a vertical chute of the dispensing apparatus and having a open bottom end permitting the packages to be serially dispensed by manual manipulation of the lowermost package within the cartridge.

BACKGROUND OF THE INVENTION

Vertically upright package dispensers for wall mounting and like, have been devised to include a rectangular storage and dispensing passage or chute having open ends. Such devices include a retainer flange extending inwardly from a wall defining the chute towards an opposite passage wall to retain the lowermost article of a series of identical articles retained within the passage or chute. The front wall of the display package dispenser has an opening at the bottom of the chute through which the lowermost article in contact with the retainer flange may be moved by manual manipulation such as by grasping the package between the thumb and a finger either from opposite sides, or from front to rear.

U.S. Pat. Nos. 2,147,086 issued Feb. 14, 1939 to J. O. Bryan; 3,210,140 issued Oct. 5, 1965 to W. T. Smythe; U.S. Pat. 3,858,757 issued Jan. 7, 1975 to Richard H. Langdon, Jr.; U.S. Pat. No. 3,957,174 issued May 18, 1976 to Joseph P. Palamara and U.S. Pat. No. 4,148,413 issued Apr. 10, 1979 to Vincent J. Immordino are representative of such vertically mountable, storage, display and dispensing apparatus.

Where such apparatus is formed with laterally opposed U-shaped guides for the packages supported on a rear wall, and facing outwardly thereof, the packages are exposed between the laterally opposed guides. Where the articles to be dispensed are stacked internally of an opaque chute, either the articles are hidden from view, or only the lowermost article may be visually observed. In the known types of article storage, display and dispensing devices the number of articles maintained in a vertical array is limited by the height of the dispensing device or apparatus.

It is therefore an object of the present invention to provide improved article storage, display and dispensing apparatus which is aesthetically pleasing, which permits the stacking and displaying of all articles of the stack with the number of articles being well in excess of the height of the storage display and dispensing apparatus, in which the apparatus is formed of transparent plastic material to permit ready viewing of the articles carried thereby, and wherein, the apparatus includes a chute receiving an inserted, removable clear plastic tubular cartridge housing the stack of articles to be displayed and dispensed and whose length exceeds the length of the chute of the apparatus through which the articles are dispensed.

DESCRIPTION OF THE PREFERRED EMBODIMENTS OF THE INVENTION

Figure 5:
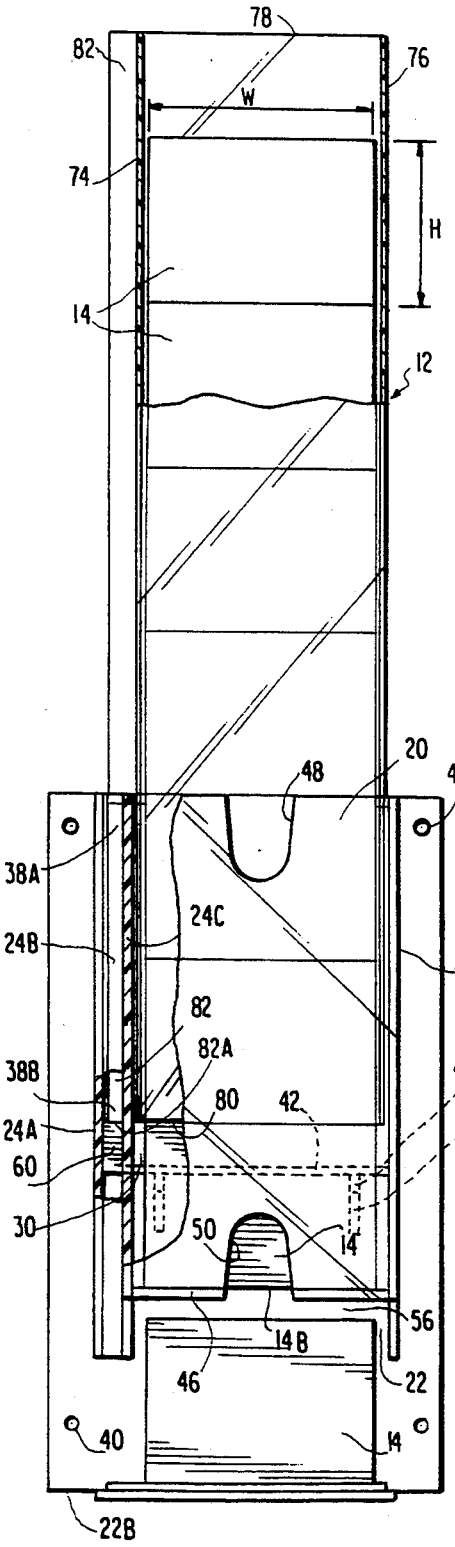
FIG. 5 is a front elevational view, partially broken away, of the dispenser and cartridge of FIG. 1, with the cartridge mounted therein and with a lowermost article of the stack positioned on a package retainer flange for manual dispensing through a front, bottom opening thereof.

This invention involves multiple aspects; an article storage, a display and dispensing apparatus are indicated generally as device 10, a tubular package cartridge or a sleeve indicated generally at 18, and a combined storage, display and dispensing apparatus and insertably mounted cartridge assembly 12 carrying a stack of articles 14 to be dispensed and indicated generally, FIG. 5. As may be appreciated, the articles being dispensed from the insertable received cartridge 12, FIG. 5 are of rectangular, parallelepiped form, such as cigarette packages, or like boxes or containers of similar form and sized slightly smaller than the rectangular dimensions of the hollow rectangular cartridge or sleeve 12 within which the articles or packages 14 are originally stacked. Normally, the cartridge 12 bearing the articles 14 is closed at its opposite open ends to retain the articles by closure tapes or the like (not shown) and having been removed for illustrative purposes prior to the assembly as per FIG. 5 by insertion of the lower end of the cartridge 12 into an interior chute 30 of the dispenser 10, sized slightly larger but of similar rectangular cross sectional configuration.

Preferably the cartridge or sleeve 12, as well as the storage, display and dispensing apparatus or device 10 are formed of plastic. The apparatus 10 is hereafter referred to as a dispensing apparatus for simplicity purposes and may be of clear molded plastic so that the articles 14 as well as the cartridge may be viewed through the transparent walls of that member. Alternatively, parts of the dispensing apparatus 10 may be formed of extruded molded plastic. Correspondingly, preferably the removable and replaceable cartridge or sleeve 12 is formed of a clear plastic thin flexible film material which may be extruded into the tubular form shown in FIG. 1 or formed from a thin flexible plastic sheet material and thermoplastically bent into hollow elongated rectangular cross-sectional shape as per FIG. 2 with opposite ends thereof contacting each other, and with such ends being suitably thermal-bonded or otherwise sealed to each other to create a flange 82' which projects outwardly from one side, 74' of the cartridge 12'. Such an aspect is also part of the invention and plays a significant part in maintaining the position of the insertable cartridge within chute 30 and maintained in a proper position at some raised level relative to a retainer flange within the tubular chute 30 at the bottom thereof and functioning as a stop for the gravity deposited lowermost package 14 within the removable sleeve or cartridge 12.

The combined clear molded plastic storage package, display and dispenser and apparatus or device, and the insertably carried removable tubular clear plastic tubular sleeve or cartridge, at 18 permits an extended stack of packages 14 to be stored in such sleeve or cartridge 12 whose length may be several times that of the vertical height of the dispenser apparatus 10.

Figure 3:
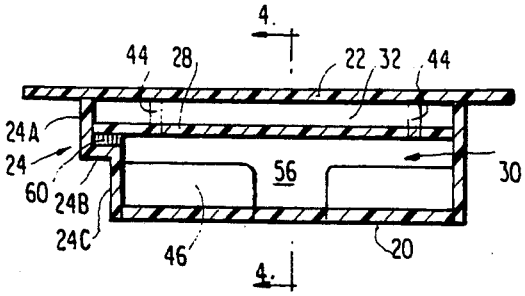
FIG. 3 is a sectional view the dispenser taken about line 3—3 of FIG. 1.

The dispensing apparatus 10 which may be preferably molded of injection-molded thermoplastic material such as polystyrene, which is an easily molded synthetic resin which is transparent and has high strength and impact resistance, comprises principly, a front wall 20, a rear wall 22, a stepped side wall 24 to the left, FIG. 3 and a flat planar side wall 26 to the right. The left side wall 24 is stepped so as to include a vertically upright sidewall section 24A, an integral short width sidewall portion 24B, and a flexible integral, right angle vertical side wall right angle section 24C. An integral chute rear wall 28 extends a slight distance rearwardly of the stopped side wall section 24B to define therewith a narrow, vertical flange receiving slot 38. The upper end 38A is open, and the lower end 38B is closed off by a small rectangular block of clear plastic material, constituting a cartridge or sleeve stop 60.

The stop 60 may be thermobonded into place in face to face contact with the horizontal stepped section 24B of side wall 24 and the front surface of the chute rear wall 28.

The dispenser apparatus rear wall 22 and the chute rear wall 28 define a vertical space or cavity 32 which is open at the top at 32A, and which is closed off at the bottom 32B by a horizontal integrally molded wall 42. Additionally, vertical reinforcing members 44 or ramps are integrally molded into the apparatus 10 and project vertically downwardly from the horizontal bottom wall 42 to opposite sides of the structure, having downwardly and rearwardly obliqued beveled edges 44A. These edges tend to function as guides for the lowermost package 14 when removing it from the dispenser by moving it off the horizontal package retainer flange 46 integrally molded into the front wall 20 at the lower end thereof and projecting rearwardly. The front wall 20, at chute 30, is provided at an open upper end with a U-shaped figure notch 48, at the center of the top edge 20A thereof.

Figure 4:
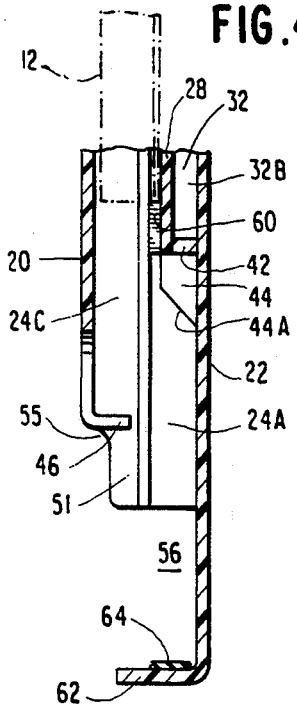
FIG. 4 is a vertical sectional view of a portion of the dispenser of FIG. 1 taken about line 4—4 of FIG. 3.

A mirror image inverted U-shaped finger notch 50 is provided within the center of front wall 20 of the apparatus 10, at its bottom, vertically in line with finger notch 48 and emanating from the upper edge 20A of that front wall. The lower finger notch 50 separates the package retainer flange 46, into two sections, to the left and right of the notch. The side walls 24 and 26 extend below the retainer flange 46, which projects rearwardly in the direction of the chute rear wall 28. However, the chute rear wall 28 stops at some distance D above the level of the retainer flange 46. The distance D, FIG. 4 is less than the vertical height H of the package or article 14 so that the lowermost package 14 to be dispensed, upon falling by gravity against the top of the retainer flange 46, cannot move into a rectangular cavity 56 beneath the rear edge 46A of the retaining flange 46, and defined by the rear wall 22 of the molded plastic dispenser 10 and front wall 20. Further, the existence of the two projections or ramps 44 of a thickness equal to the width of the bottom wall 42 of chamber 32 prevents such article or package 14 from tilting into cavity 56 at its upper end, even if it were of a height which was less than the distance D between the retainer flange 46 and the bottom surface of bottom wall 42. The narrow section 24C of the side wall 24 is reduced at 51 below the retainer flange 46, by a recess 55. A reduced width portion 53 of side wall 26 is defined by recess 57. Such recesses 53, 57 permit finger and thumb access to opposite sides of the lowermost package 14 when moved to the position shown in FIG. 6A, such that the lower edge of the package 14 rests on an elastomeric bumper 64 which lines the upper surface of a right angle, horizontal dispenser rear wall package retainer flange 62. Flange 62 is of a width slightly in excess of the width W of the package, FIG. 5 and being on the order of the width between portions 51 and 53 of respective side walls 24, 26 of the apparatus 10. The dispenser rear wall package retainer flange 62, which extends horizontally, is integrally molded to the lower edge 22B of the article dispenser 10. It is of front to rear width generally on the order of the width of side wall 26 recessed portion 53 below the front wall retainer flange 46.

Figure 1:
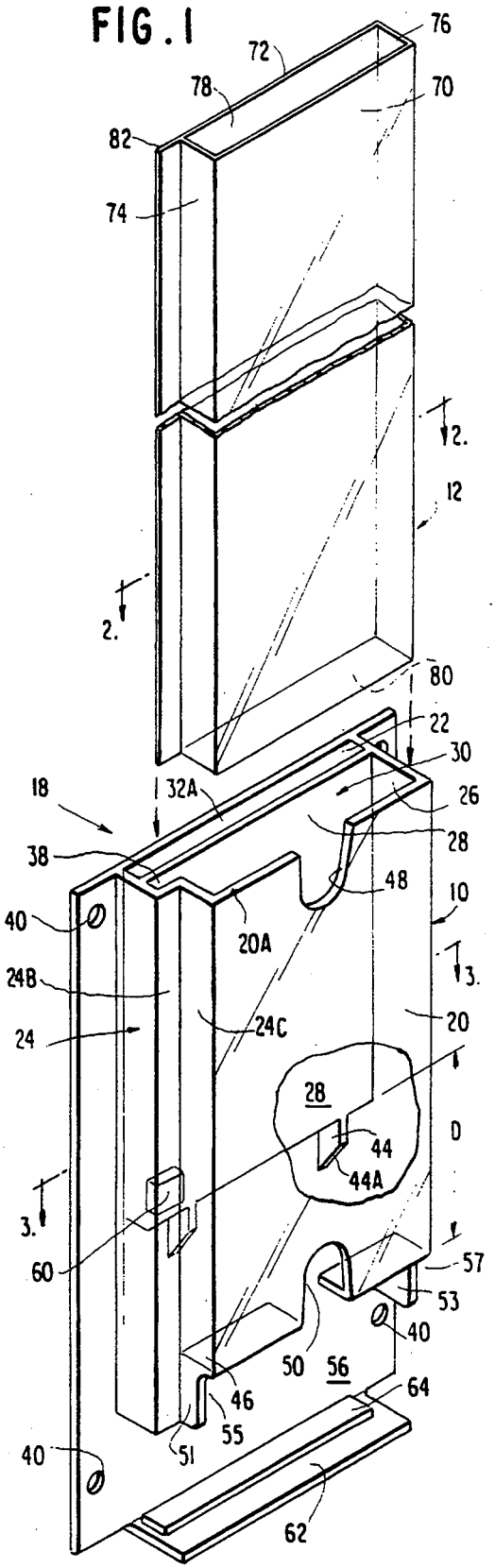
FIG. 1 is an exploded perspective view of an improved transparent package dispenser and see-through replaceable tabular cartridge for carrying a stack of packages and for insertable mounting within a dispenser chute of the dispenser.

The rear wall 22 of the article dispenser 10 includes holes 40 at the four corners thereof permitting the article dispenser 10 to be mounted to a vertical wall surface by screws (not shown) at a height permitting ready viewing of the articles 12 through the transparent article dispenser 10 and the clear plastic insertable renewable cartridge or sleeve 12 when positioned therein as indicated by the dotted arrows in FIG. 1.

Figure 2:
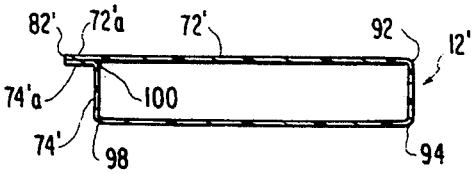
FIG. 2 is a sectional view of the removable cartridge of FIG. 1, taken about line 2—2 thereof.

Turning to FIGS. 1, 2 and 3 which illustrate in detail the structural makeup of the removable cartridge or sleeve 12, it is seen that the sleeve or cartridge 12 complements the internal dimensions of the chute 30 and its integral cartridge flange receiving vertical slot 38. In the embodiment of the cartridge or sleeve 12 as shown in FIG. 1, the cartridge 12 is also formed of injection-molded thermoplastic material such as polystyrene having a front wall 70, a rear wall 72 opposite right angle side wall 74, 76 with the rear wall 72 being extended on the left side of FIG. 1, and in line therewith, to form a planar flange 82 of limited lateral width. The flange 82 runs the full vertical height or length of the cartridge or sleeve 12.

Alternatively, in accordance with FIG. 2, the cartridge or sleeve 12' in which like elements are given prime designations, both the rear wall 72' and side wall 74' are extended, at **72'*a*, and 74'*a*, respectively with the extension 74'*a* of the side wall bent at right angles, and in face contact with rear wall extension 72'*a* so as to form a double thickness flange 82'. In this case, the clear plastic tubular cartridge or sleeve 12, of generally rectangular cross section, is formed from a thin sheet of flexible transparent plastic sheet material which is thermoplastically bent at right angles at corners 92, 94, 98 and 100 and, the double thickness flange 82' has its extension portions 72'*a* and 74'*a* thermobonded together to lock the thin flexible plastic sheet material into permanent shape as shown in FIG. 2 with the flange 82' extending outwardly from the left side thereof and coplanar with rear wall 72'**.

With the exception of the double thickness flange 82' the dimensions and the thickness of the plastic cartridge or sleeve 12 and 12' are identical. As mentioned previously, the overall length of the cartridge or sleeve 12 and that of 12' may be several times in excess of the vertical height of the article dispenser 10 and particularly the chute 30 which receives the lower end of that cartridge. As may be appreciated, the cartridge or sleeve as at 12 may be formed of an extruded clear plastic material with the upper and lower ends 78, 80 open and readily closed off by removable strips of tape or the like after a number of articles such as packages 14 are stacked as an array internally of an article storage chamber in the respective embodiments.

FIG. 5 illustrates a condition in which the cartridge or sleeve 12 has its lower end 80 fully inserted with the chute 30 to an extent where the bottom edge 82A of the flange 82 abuts the top surface of the stop 60 fixedly mounted within slot 38. The position of the stop 60 is such that the top of the lowermost package 14 in the stack is still within the bottom of the cartridge or sleeve 12 when the lower edge of such package, box, or like article 14 abuts the retainer flange 46 integral with the front wall 20 of the dispenser 10 and is held in such position until dispensing takes place. During dispensing, the lower edge 14B of the package, box or other parallelepiped article 14 falls onto bumper 64 situated to the rear of the front edge of the forwardly directed retainer flange 62. In that position, the article 14 may be grasped by a finger and thumb T of a person attempting to remove the same in the direction of arrow R as per FIG. 6A grasping the package from opposite sides.

Figure 6A:
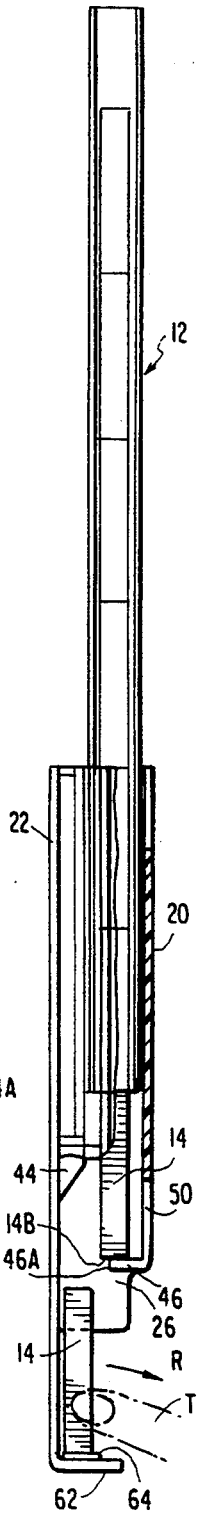
FIG. 6A, 6B and 6C are left-side elevational views of the dispenser and cartridge of FIG. 5, partially broken away and illustrating the sequence in removal of a dispensed lowermost article, and the dispensing of a succeeding article from the stack.
Figure 6B:
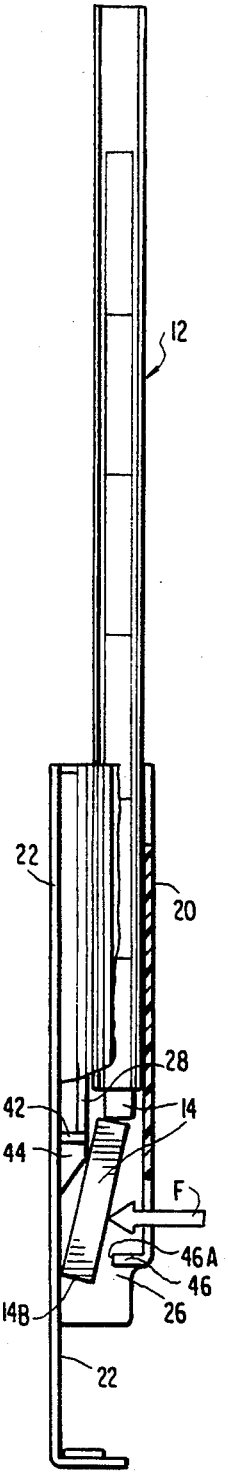
Figure 6C:
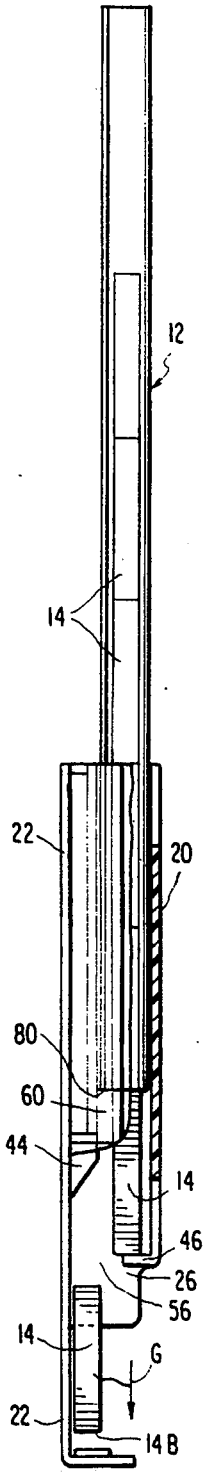

Such action takes place in the sequence from FIG. 6A to 6B. After the lowermost article 14 is removed, FIG. 6A, the succeeding article 14 which has its lower edge 14B resting on the rearwardly projecting retainer flange of shelf 46, may be manually tilted rearwardly and downwardly oblique, as shown in FIG. 6B, by a finger or thumb projected through the lower finger notch 50 as indicated by the headed arrow F (FIG. 6B). Because of the presence of the two ramps 44A, the package 14 cannot retain its vertically upright position, but rather tilts so that the bottom edge or surface 14B slides off the edge 46A of the retainer flange 46. Thereafter, it falls by gravity as indicated by the arrow G, FIG. 6C, retaining its vertically upright position, and is deposited on the upper surface of bumper 64. At that point, the storage, display and dispensing apparatus 18 returns to the condition shown in FIG. 5.

In order for the storage, display and dispensing apparatus 18 to operate efficiently in the display and dispensing of articles such as cigarette packages, boxes, rectangular tape containers or the like stacked within the sleeve or cartridge whose lower end is in turn inserted vertically into chute 30 of the article dispenser 10, relative dimensions and spacing of certain components are critical to the successful operation of the system or apparatus 18. The distance D between the front wall retainer flange 46 and the open end 80 of the cartridge when the cartridge 12 contacts the stop 60 should be less than the vertical height H of the articles 12 so as to prevent premature movement of the lowermost article 12 into the chamber 56. Dispensing is effected by a force F applied against the front lower portion of the article as per arrow F of FIG. 6B. This leads to the further greater vertical movement of the article 14 onto the forwardly projecting rear wall shelf or retainer flange 62. Further, it is important that the vertical distance from the rear wall, forwardly directed retainer flange 62 to the bottom of the rearwardly directed front wall retainer flange 46 be in excess of the vertical height H of the article 14, so that the an article 14 resting on the retainer flange 62 (or its bumper 64) and extending vertically upwardly therefrom can physically be removed by pulling it away from the rear wall 22, and in the direction of the open bottom end 54 of the front wall 20. Such movement is in the direction of arrow R, FIG. 6A.

Further, the side walls 24 and 26 defining the retainer flange 46, to maintain the article 14 when resting on the bumper 64 in a vertical upright position prevented from falling off the shelf laterally to either side of the retainer flange 46.

It should be additionally kept in mind, that while the removable cartridge or sleeve 12 is required to incorporate an element thereof which acts as an abutment with the stop 60 to limit the insertion depth of the sleeve or cartridge 12 within chute 30, it need not be the lower edge 82A of an integral flange 82 projecting laterally from one side of the tubular cartridge 12. For instance, it is feasible to provide within the chute rear wall 28, a vertical slot from an upper edge, downwardly to a distance just above the bottom wall 46 of the article dispenser 10, and to mold integrally within the rear wall 72 or, 72' of the removable cartridge or sleeve 12, a rearwardly projecting stop sized slightly smaller than the slot within the chute rear wall 28 and positioned therein so that such stop, in proximity to the open lower end 80 of the cartridge as a rear projection, abuts the bottom of the slot thereby terminating the further insertion of the cartridge or sleeve 12 carrying a suitable stack of articles 14 as per FIG. 5.

Further, one or both of the article dispenser 10 and its insertably received sleeve or cartridge 12 may be formed of a material which is opaque rather than transparent without a departure from the invention. However, preferably, at least the cartridge or sleeve should be formed of such transparent molded plastic so that a number of articles 14 above the top of article dispense 10 and may be readily viewed to permit the assembly 18 to function adequately in its preferred, partial use as a display for the articles to be selectively dispensed.

From the foregoing, those versed in the art will appreciate that the present invention achieves the objects and realizes the advantages herein before mentioned, as well as other advantages which will be apparent from the description and drawings.

Although a specific embodiment of the present invention has been illustrated and described herein, it will be understood that such embodiment is exemplary only of preferred embodiments capable of attaining the objects and advantages hereinbefore mentioned. The invention therefore is not limited thereto and variations will be readily apparent to those first in the art. Thus, the invention is entitled to the broadest interpretation within the terms of the claims appended hereto.

What is claimed is:

1. In combination, an article dispenser and tubular replaceable cartridge:

said article dispenser comprising spaced front and rear walls, spaced side walls integral with said front and rear walls along opposite sides thereof, means including said side walls and at least one of said front and rear walls forming a vertical chute defining a vertical passageway having open upper and lower ends, one of said front and rear walls including a first horizontal retainer flange projecting into the interior of said passageway, at a lower end of said chute, the other of said front and rear walls including a second horizontal retainer flange projecting toward said first retainer flange and being spaced below said first retainer flange a distance in excess of the height of a said article, means defining an opening within the front wall below said first retainer flange for removal of an article resting on said second retainer flange, said tubular replaceable cartridge being sized smaller in cross section than said chute passageway and configured to that passageway, said cartridge having a lower end inserted within said chute passageway, stop means carried by said article dispenser for limiting the extent of insertion of said lower end of said cartridge into said passageway to a position above the first retainer flange, whereby a lowermost article of said stack may move by gravity from an open lower end of said cartridge into abutment with said first retainer flange with an upper edge of the lowermost article remaining within the lower end of said tubular cartridge, said article dispenser further including a rearwardly enlarged cavity within a lower end of the article dispenser below said stop and being spaced front to rear from an edge of said first horizontal retainer flange remote from one of said front and rear walls a distance in excess of the thickness of said articles to be dispensed, and means carried by said chute for access to said article on said first retainer flange for manual pushing of said lowermost article off said first retainer flange to cause the article to ride over the first retainer flange, thereby paralleling said lowermost article to fall by gravity downwardly within said front to rear enlarged cavity and into a vertically upright position and lower edge contact with said second retainer flange whereby manual removal of said lowermost article through said article removal opening within said article dispenser may be effected.

2. The combination as claimed in claim 1, wherein article dispenser includes a chute rear wall spaced forwardly of said dispenser rear wall, extending parallel thereto over a length of the article dispenser from an upper edge of said chute to said stop means, such that said front to rear enlarged cavity extends beneath the bottom and rearwardly of the dispenser chute rear wall, from said front wall to said article dispenser rear wall.

3. The combination as claimed in claim 2, wherein said article dispenser rear wall and said chute rear wall define a chamber extending parallel with and to the rear of said chute passageway and wherein, said article dispenser further includes at least one ramp within said front to rear enlarged cavity beneath said chamber, and below the said cartridge stop, and wherein said front wall comprises an opening facing said rear wall, below said at least one ramp and above said first retainer flange whereby, a force applied through said means for access against the bottom of the said lowermost article when resting on said first retainer flange causes said lowermost article to be pushed off an edge of the first retainer flange and to thereby pass by a gravity downwardly over said first retainer flange edge, and to move into a vertically upright position onto said second retainer flange carried by said rear wall and projecting outwardly thereof and partially defining said access opening for removing said lowermost article from said article dispenser.

4. The combination as claimed in claim 3, wherein said article dispenser includes a horizontal bottom wall closing off a lower end of said chamber and said at least one ramp comprises a pair of laterally spaced planar projections integrated with said chamber bottom wall and extending downwardly therefrom and terminating in downwardly and rearwardly oblique edges for retaining an upper end of said lowermost article as the lower end of said lowermost article is pushed off the edge of said first retainer flange.

5. The combination as claimed in claim 1, wherein said second retainer flange carries an elastomeric bumper on an upper surface thereof to dampen impact of a gravity drop of the lowermost article as it falls by gravity off the first retainer flange and moves downwardly within said front to rear enlarged cavity.

6. The combination as claimed in claim 1, further comprising an opening within the front wall of said article dispenser providing access to said chute passageway, for facilitating insertion of the lower end of the removable cartridge into said chute passageway during mounting of said cartridge to said article dispenser.

7. The combination as claimed in claim 1, wherein the side walls of the article dispenser partially defining said chute passageway terminate at a distance above the second retainer flange which is less than the vertical height of an article being dispensed to prevent inadvertent discharge of the lowermost article from said front to rear enlarged cavity when positioned in contact with said second retainer flange.

8. The combination as claimed in claim 1, wherein said first retainer flange extends rearwardly from said front wall in the direction of said rear wall and is spaced therefrom a distance in excess of the thickness of said articles being dispensed.

9. The combination as claimed in claim 8, and wherein, said second retainer flange extends horizontally, from said rear wall in the direction of said front wall and is of a front to rear width on the order of the width of said side walls defining said chute.

10. The combination as claimed in claim 1, wherein one of said side walls of said article dispenser is stepped transversely, between said front wall and said chute rear wall to define a vertical flange receiving slot open to said chute passageway as an extension thereof, and wherein said cartridge includes a rear wall flange which extends laterally beyond a side wall thereof proximate to the laterally stepped side wall of said article dispenser, and said cartridge rear wall flange is received therein and wherein, said stop means for positioning said cartridge comprises a block, fixedly mounted within said flange receiving slot and being sized to said slot such that upon vertical insertion of the removable cartridge, a lower edge of the cartridge rear wall defining flange abuts the stop to prevent further movement of the cartridge into the chute passageway.

11. The combination as claimed in claim 10, wherein said removable cartridge is an injection molded cartridge having uniform thickness walls including said cartridge flange.

12. The combination as claimed in claim 10, wherein said removable cartridge comprises a thin flexible sheet of plastic bent at four corners into a rectangular tubular cross section and wherein, one of said side walls is provided with a short length, right angle flange extending away from said one side wall and one of said rear front and rear walls is extended beyond said side wall flange a distance equal thereto and abuts said side wall flange, such that said flange is constituted by a double thickness of said thin flexible sheet material and said one of said rear wall and said front wall at said flange is thermobonded to the flange of said one side wall.

13. A transparent display package dispenser for use with a see-through replaceable cartridge, said cartridge comprising an elongated removable, tubular member for carrying a stack of parallelepiped articles, said package dispenser comprising spaced front and rear walls, spaced side walls integral with said front and rear walls along opposite sides thereof, means including said side walls and at least one of said front and rear walls forming a vertical chute defining a vertical passageway having open upper and lower ends, one of said front and rear walls including a first horizontal retainer flange projecting into the interior of said passageway at a lower end of the chute, the other of said front and rear walls including a second horizontal retainer flange projecting toward said first retainer flange and being spaced below the first retainer flange a distance in excess of height of said article, means defining a first opening within the front wall below the first retainer flange for removal of an article resting on said second retainer flange after dispensing from said chute passageway whereby, with said replaceable cartridge being of tubular form and sized smaller than the chute passageway and configured to that passageway and with said cartridge having a lower end inserted within the chute passageway, said dispenser further comprising means for limiting the extent of insertion of the lower end of said cartridge into said passageway to a position above said first retainer flange, whereby a lowermost article of said stack may move by gravity from an open lower end of the cartridge into abutment with said first retainer flange and with an upper edge of the lowermost article remaining within the lower end of the tubular cartridge, said article dispenser further including a rearwardly directed enlarged cavity within a lower end of the article dispenser below said means for limiting and being spaced front to rear from an edge of said first horizontal retainer flange remote from one of said front and rear walls a distance in excess of the thickness of said articles to be dispensed, and means carried by said chute for access to said article and said first retainer flange for manual pushing of said lowermost article off of said first retainer flange and to ride over the first retainer flange, thereby permitting said lowermost article to thereafter fall by gravity downwardly within said front to rear enlarged cavity and into a vertically upright position with a lower edge thereof in contact with said second retainer flange and thereby permitting further manual removal of said lowermost article through said article removing opening within said article dispenser.

14. The article dispenser as claimed in claim 13, wherein said article dispenser includes a chute rear wall spaced forwardly of the said dispenser rear wall and extending parallel thereto over a length of the article dispenser from an upper edge of said chute to said cartridge stop, whereby said front to rear enlarged cavity extends beneath the bottom and rearwardly of the dispenser chute rear wall, from said front wall to said article dispenser rear wall.

15. The article dispenser as claimed in claim 14, wherein said article dispenser rear wall and said chute rear wall define a chamber extending parallel with and to the rear of the chute passageway and wherein, said article dispenser further includes at least one ramp within said front to rear enlarged cavity beneath said chamber and below said means for limiting, and wherein said front wall further comprises a second opening facing the rear wall below said at least one ramp and above said first retainer flange whereby a force applied through said front wall second opening to the bottom of said lowermost article when resting on said first retainer flange causes said lowermost article to be pushed off an edge of the first retainer flange and to thereby pass by gravity downwardly over said first retainer flange edge and to move into a vertically upright position on said second retainer flange carried by the rear wall and projecting outwardly therefrom and partially defining said first opening for removing said lowermost article from said article dispenser.

16. The article dispenser as claimed in claim 15, further including a horizontal bottom wall closing off a lower end of said chamber and wherein said at least one ramp comprises a pair of laterally spaced planar projections integrated with said chamber bottom wall and extending vertically downwardly therefrom, each projection terminating in a downwardly and rearwardly oblique edge for guiding an upper end of the lowermost article as a lower end of the lowermost article is pushed off the edge of said first retainer flange.

17. The article dispenser as claimed in claim 13, wherein said second retainer flange carries an elastomeric bumper on an upper surface thereof to dampen impact of a gravity drop of the lowermost article as it falls by gravity off the first retainer flange and downwardly within the rearwardly directed enlarged cavity.

18. The article dispenser as claimed in claim 13, wherein the side walls of the article dispenser partially defining said chute passageway terminate at a distance above the second retainer flange which is less than the vertical height of each article being dispensed to prevent inadvertent lateral discharge of the lowermost article from the rearwardly directed enlarged cavity when positioned in contact with said second retainer flange.

19. The article dispenser as claimed in claim 14, wherein said cartridge includes a rear wall flange which extends laterally beyond a side wall thereof, and wherein one of said side walls of said article dispenser is stepped transversely between said front wall and said chute rear wall to define a vertical flange receiving slot open along one side to the chute passageway as an extension of the chute passageway, said means for limiting comprises a block fixedly mounted within said flange receiving slot, being sized to the slot and blocking the same such that upon vertical insertion of the removable cartridge, a lower edge of the cartridge rear wall flange abuts the stop to prevent further movement of the cartridge into the chute passageway.

20. An enlongated removable tubular replaceable cartridge for carrying a stack of articles to be dispensed from an article dispenser;

said article dispenser comprising spaced front and rear walls, spaced side walls integral with said front and rear walls along opposite sides thereof, means including said side walls of at least one of said front and rear walls forming a vertical chute defining a vertical passageway having open upper and lower ends, one of said front and rear walls including a first horizontal retainer flange projecting into the interior of said passageway at a lower end of said chute, the other of said front and rear walls including a second horizontal retainer flange projecting toward said first retainer flange and being spaced below the first retainer flange a distance in excess of the height of a said article, means defining an opening within the front wall below said first retainer flange for removal of an article resting on said second retainer flange, said elongated removable tubular cartridge being sized smaller in cross section than said chute passageway and being configured to that passageway, stop means carried by said article dispenser for limiting the extent of insertion of a lower end of said cartridge into said passageway to a position above said first retainer flange a distance less than the height of one of said articles whereby a lowermost article of the stack may move by gravity from an open lower end of the cartridge into abutment with said first retainer flange, and with an upper edge of the lowermost article remaining within the lower end of said tubular cartridge, said tubular cartridge including an abutment cartridge flange for movement into contact with said stop means carried by said article dispenser when the lower end of said cartridge reaches said position above said first retainer flange for defining the extent of insertion of said cartridge into said chute.

* * * * *